US007428977B2

(12) United States Patent
Fera

(10) Patent No.: US 7,428,977 B2
(45) Date of Patent: Sep. 30, 2008

(54) DRIPLESS PAINT BUCKET

(76) Inventor: Jack A. Fera, 194 Washington Valley Rd., Morristown, NJ (US) 07960

( * ) Notice: Subject to any disclaimer, the term of this patent is extended or adjusted under 35 U.S.C. 154(b) by 311 days.

(21) Appl. No.: 11/267,842

(22) Filed: Nov. 7, 2005

(65) Prior Publication Data

US 2007/0102435 A1 May 10, 2007

(51) Int. Cl.
*B65D 25/00* (2006.01)
*B65D 90/00* (2006.01)

(52) U.S. Cl. ..... 220/699

(58) Field of Classification Search ..... 220/698, 220/699, 702, 735

See application file for complete search history.

(56) References Cited

U.S. PATENT DOCUMENTS 332,043 A * 12/1885 Brien ..... 220/698
1,696,240 A 12/1928 Kircher, Jr.
2,705,334 A 4/1955 Farrow
2,996,215 A 8/1961 Giza
3,397,804 A 8/1968 Davis
3,688,943 A 9/1972 Brown
3,727,792 A 4/1973 Levin
4,615,456 A 10/1986 Cousar
5,779,093 A 7/1998 Poole et al.
5,810,196 A 9/1998 Lundy
RE35,933 E 10/1998 Scholl
6,609,629 B2 8/2003 Lucey

* cited by examiner

*Primary Examiner*—Anthony D Stashick
*Assistant Examiner*—Harry A Grosso
(74) *Attorney, Agent, or Firm*—John Chiatalas

(57) ABSTRACT

A bucket has a container portion formed of a rim defining an open top, a closed bottom spaced downwardly from the top and a sidewall extending between the top and bottom. A wiping lip is spaced inboard of rim and a support bracket is provided for suspending the lip in its inboard position. Bracket has a lower portion spaced downwardly from rim and affixed to an interior location of the sidewall, with an upper portion terminating in the lip. The bracket forms a trough for stowage of a paint applicator. A dimension of the lip internally accommodates another dimension of the bottom to allow shipping and vertical stacking for retail display of multiple buckets in a telescoping fashion.

20 Claims, 2 Drawing Sheets

DRIPLESS PAINT BUCKET

TECHNICAL FIELD

The present invention generally concerns portable paint buckets, of the type carried by residential and commercial painters employing manual brush and roller applicators.

BACKGROUND

When used for any period of time, excess paint tends to accumulate on the rim of a paint bucket, from continually wiping the applicator, e.g., a paintbrush, against the rim. This excess paint eventually drips on the surface where the bucket is sitting or drips while the bucket is being carried.

One approach to ameliorating this problem has been to provide an inner lip on the bucket, so that excess paint wiped against the lip drips back into the bucket and not on the floor. Examples of such buckets include: U.S. Pat. No. 6,609,629 to Lucey, which has a lip extending outboard and sitting proud of its rim, with a configuration said to allow multiple buckets to be stacked. U.S. Pat. No. 4,615,456 to Cousar shows a modular bucket with space for a brush to rest. U.S. Pat. No. 1,696,240 to Kircher, Jr. shows a metal bucket having a lip brace extending radially between its rim and lip; the brace is generally coplanar to the rim. Neither of the above patents describes: a lip brace attached below the rim to a sidewall of a paint bucket, with the brace forming a trough for stowage of applicator brushes or rollers; nor is such a bucket described that is optionally stackable for retail display.

SUMMARY

According to the present invention, a painter's bucket is disclosed having a container portion including a rim defining an open top, a closed bottom spaced downwardly from the top and a side wall extending between the top and bottom. A wiping lip is spaced inboard of the rim and a support bracket is provided for suspending the lip in its inboard position. The bracket has a lower portion spaced downwardly from the rim and affixed to an interior location of the sidewall and an upper portion terminating in the lip. The bracket forms a trough for stowage of a paint applicator.

In a preferred embodiment, the rim, bottom and sidewall dimensions of the bucket are shaped and sized to allow stacking of multiple buckets for retail display. More preferably, the buckets are of a unitary molded plastic construction.

An advantage of the present invention is an improved, relatively dripless paint bucket having a wiping lip formed from a bracket that also provides a trough for brush/roller stowage and carrying.

Other objects and advantages will become apparent to a reader skilled in the art, with reference to the following Figures and accompanying Detailed Description wherein textual reference characters correspond to those denoted on the Drawings.

DETAIL DESCRIPTION

Referring to FIGS. 1-4, there is provided a painter's bucket generally shown at 10, 110 according to the present invention. Bucket 10, 110 typically has a carrying handle (not shown) made of plastic strip, metal wire or other suitable materials and shapes. Bucket 10, 110 is preferably of a unitary plastic molded construction and is also preferably stackable in the alternate embodiments shown by FIGS. 1-3 and FIG. 4, respectively.

Figure 1:
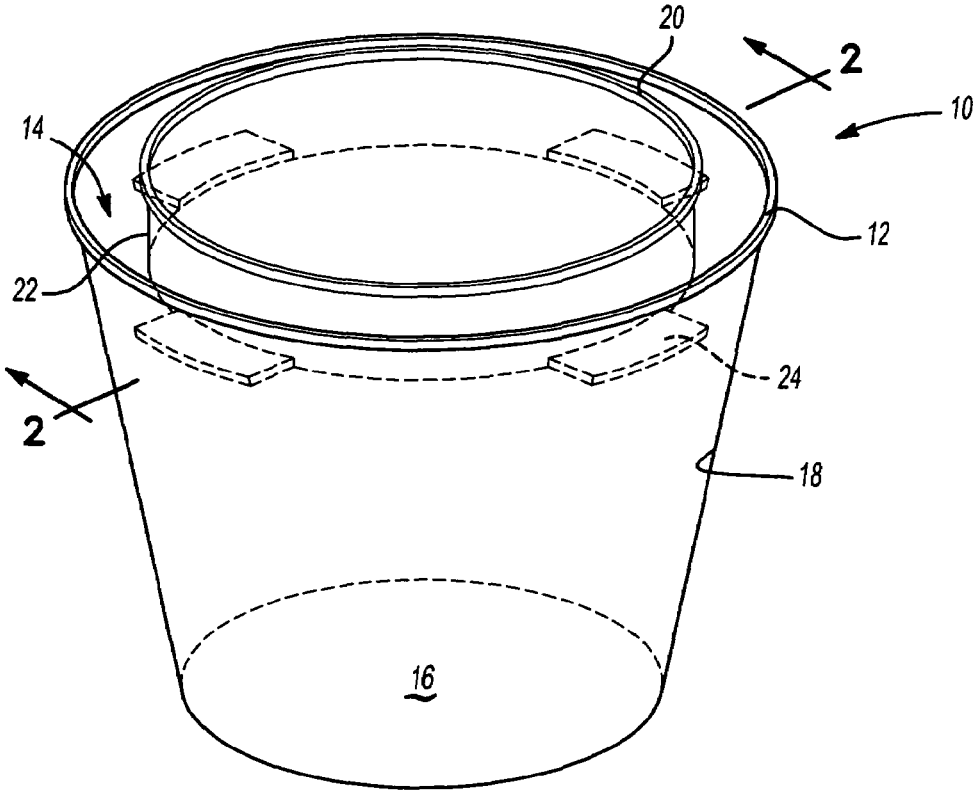
FIG. 1 is a perspective view of a paint bucket of the present invention.
Figure 2:
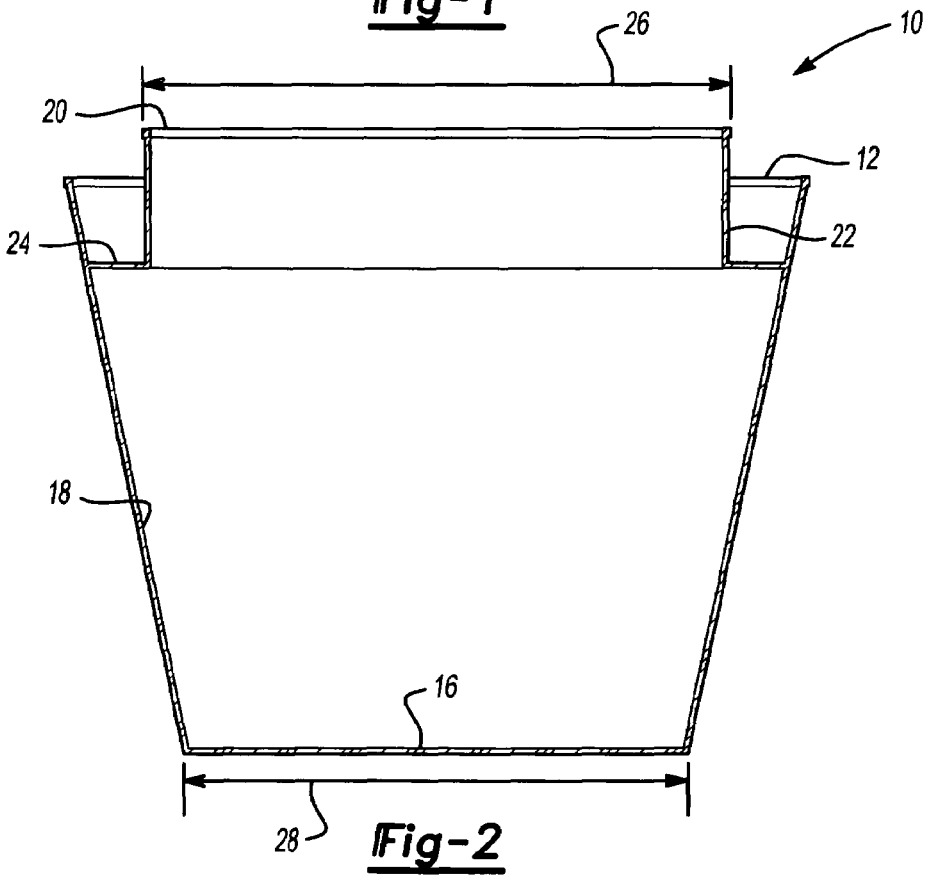
FIG. 2 is a side elevational view showing the bucket of FIG. 1.
Figure 3:
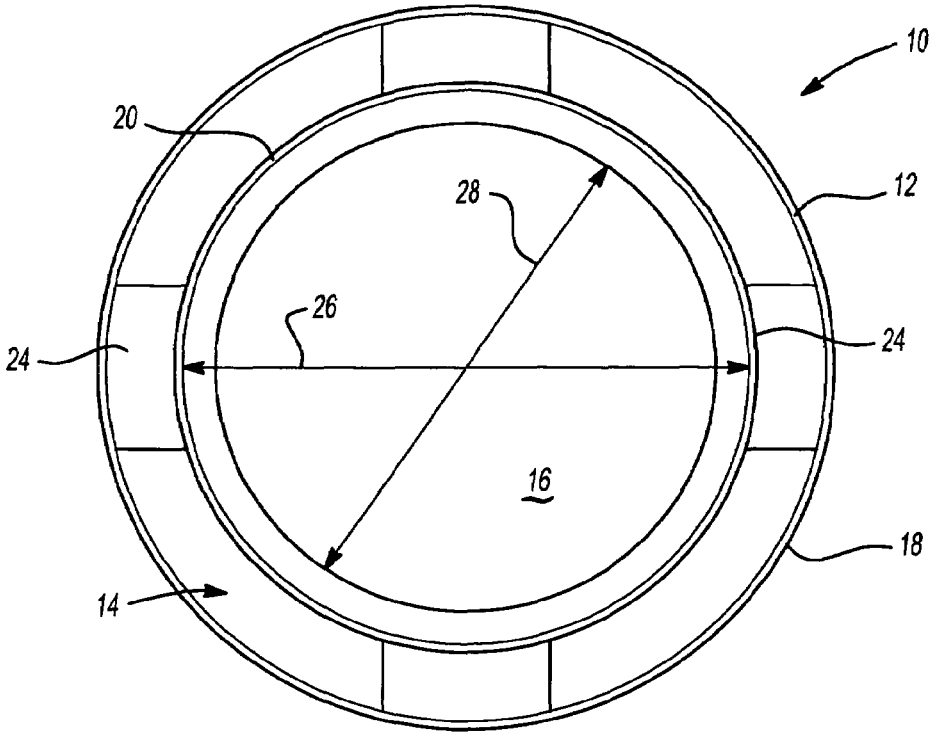
FIG. 3 is a top plan view of FIG. 2.
Figure 4:
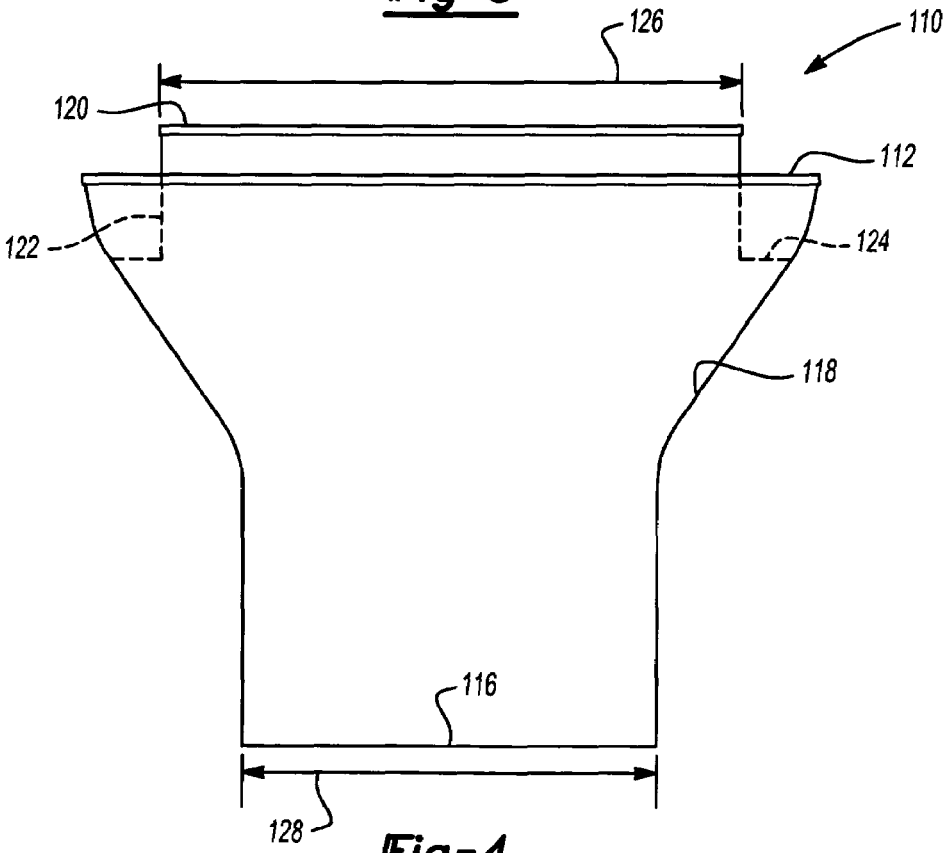
FIG. 4 is an alternative bucket of the present invention optimized for stacking to enhance retail display.

Bucket 10, 110 has a container portion formed of a rim 12, 112 defining an open top 14, 114, a closed bottom 16, 116 spaced downwardly from the top and a sidewall 18, 118 extending between the top and bottom. A wiping lip 20, 120 is spaced inboard of rim 12, 112 and a support bracket 22, 122 is provided for suspending the lip in its inboard position. Bracket 22, 122 has a lower portion 24, 124 spaced downwardly from rim 12, 112 and affixed to an interior location of sidewall 18, 118, with an upper portion terminating in lip 20, 120 substantially as shown. Bracket 22, 122 forms a trough for stowage of a paint applicator. FIGS. 2 and 4 show a dimension 26, 126 of lip 20, 120 that internally accommodates another dimension 28, 128 of bottom 16, 116 to allow vertical stacking and retail display of multiple buckets in a telescoping fashion.

While one or more preferred embodiments of the present invention have been described, it should be understood that various changes, adaptations and modifications might be made without departing from the spirit of the invention and the scope of the appended Claims.

The invention claimed is:

1. A construction painter's bucket comprising:

a container portion forming a shape defining an open top and a closed bottom spaced downwardly from the top, including a sidewall extending between and interconnecting the top and bottom, the sidewall terminating in a peripheral rim along the top;

a bracket spaced inboard of the sidewall having an elongated exterior surface including lower and upper portions, with the lower portion spaced downwardly below the rim and the upper portion presenting a wiping lip spaced above the rim;

a plurality of support members, connected to the lower portion inboard of the sidewall and extending from the lower portion to interior locations of the sidewall, respectively, suspending the wiping lip inboard of the rim; and a plurality of discrete stowage spaces defined by the support members together with the exterior surface of the bracket and the sidewall, respectively, wherein the support members present a corresponding plurality of ledges discontinuous with each other and suitable for resting a construction painter's brush.

2. The bucket of claim 1 wherein the bracket has a banded structure.

3. The bucket of claim 1 wherein the bracket has a rounded or circular shape.

4. The bucket of claim 1 wherein the bracket has a contiguous structure.

5. The bucket of claim 1 wherein the lip and rim lay in generally parallel planes.

6. The bucket of claim 1 wherein the container defines a generally rounded or circular cross-section, with the lip and rim describing rounded or circular shapes.

7. The bucket of claim 1 wherein the lip and bottom have complementary dimensions to allow vertical stacking of multiple buckets for convenient shipping and retail display.

8. A construction painter's bucket comprising:

a container portion forming a generally cylindrical or frustoconical shape defining an open top and a closed bottom spaced downwardly from the top, with a sidewall extending between and interconnecting the top and bottom and terminating in a peripheral rim along the top;

a bracket spaced inboard of the sidewall having a curved shape with an elongated exterior surface including lower and upper portions, the lower portion spaced downwardly below the rim and the upper portion spaced above the rim presenting a wiping lip;

a plurality of support members, connected to the lower portion inboard of the sidewall and extending from the lower portion to interior locations of the sidewall, respectively, suspending the wiping lip inboard of the rim; and a plurality of discrete stowage spaces defined by the support members together with the exterior surface of the bracket and the sidewall, respectively, wherein the support members present a corresponding plurality of ledges discontinuous with each other and suitable for resting a construction painter's brush.

9. The bucket of claim 8 wherein the bracket has a contiguous banded structure.

10. The bucket of claim 8 wherein the lip and rim lay in generally parallel planes.

11. The bucket of claim 8 wherein the container defines a circular cross-section, with the lip and rim describing circular shapes.

12. The bucket of claim 8 wherein the lip and bottom have complementary dimensions to allow vertical stacking of multiple buckets for convenient shipping and retail display.

13. A construction painter's bucket comprising:

a container portion forming a shape defining an open top and a closed bottom spaced downwardly from the top, including a sidewall extending between and interconnecting the top and bottom, the sidewall terminating in a peripheral rim along the top;

a bracket spaced inboard of the sidewall having an elongated exterior surface with a banded structure including lower and upper portions, with the lower portion spaced downwardly below the rim inboard of the sidewall and the upper portion presenting a wiping lip spaced above the rim;

a plurality of support members, connected to the lower portion inboard of the sidewall and extending from the lower portion to interior locations of the sidewall, respectively, suspending the wiping lip inboard of the rim; and a plurality of discrete stowage spaces defined by the support members together with the exterior surface of the bracket and the sidewall, respectively, wherein the support members present a corresponding plurality of ledges discontinuous with each other and suitable for resting a construction painter's brush.

14. The bucket of claim 13 wherein the bracket has a continuous banded structure.

15. The bucket of claim 13 wherein the bracket has a rounded or circular shape.

16. The bucket of claim 13 wherein the bracket has a contiguous structure.

17. The bucket of claim 13 wherein the lip and rim lay in generally parallel planes.

18. The bucket of claim 13 wherein the container defines a generally rounded or circular cross-section, with the lip and rim describing rounded or circular shapes.

19. The bucket of claim 13 wherein the lip and bottom have complementary dimensions to allow vertical stacking of multiple buckets for convenient shipping and retail display.

20. The bucket of claim 13 wherein the lip and rim lay in generally parallel planes.

* * * * *